US006446858B1

(12) United States Patent
Louman

(10) Patent No.: US 6,446,858 B1
(45) Date of Patent: Sep. 10, 2002

(54) PACKAGING BLANK WITH LONGITUDINAL MATERIAL WEAKENINGS

(75) Inventor: Theodor Louman, Höör (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/698,059

(22) Filed: Oct. 30, 2000

(30) Foreign Application Priority Data

Nov. 22, 1999 (CH) ..... 9904206

(51) Int. Cl.[7] ..... B65D 5/42

(52) U.S. Cl. ..... 229/5.82; 229/930; 428/130; 428/167

(58) Field of Search ..... 229/100, 930, 229/940, 5.82; 428/130, 167, 169; 493/160, 161, 402, 403

(56) References Cited

U.S. PATENT DOCUMENTS

| | | | | | |
|---|---|---|---|---|---|
| 758,672 | A | * | 5/1904 | Mayall | 229/930 |
| 1,482,569 | A | * | 2/1924 | Lange | 229/930 |
| 1,708,700 | A | | 4/1929 | Maier | |
| 1,746,284 | A | * | 2/1930 | Robinson et al. | 493/403 |
| 1,758,230 | A | | 5/1930 | Lange | |
| 1,798,475 | A | * | 3/1931 | Lange | 493/403 |
| 2,949,151 | A | * | 8/1960 | Goldstein | 229/930 |
| 2,949,827 | A | * | 8/1960 | Kempen et al. | 493/403 |
| 3,122,300 | A | * | 2/1964 | La Bombard | 229/930 |
| 3,526,566 | A | * | 9/1970 | McIlvain, Jr. et al. | 229/930 |
| 3,717,074 | A | | 2/1973 | Rasmussen | |
| 5,000,372 | A | * | 3/1991 | Hollander et al. | 229/5.82 |
| 5,064,409 | A | * | 11/1991 | Campbell et al. | 229/930 |
| 5,840,002 | A | | 11/1998 | Happ | |
| 5,888,183 | A | * | 3/1999 | Ruthenberg et al. | 493/160 |
| 5,971,266 | A | * | 10/1999 | Sampaolo et al. | 229/930 |

FOREIGN PATENT DOCUMENTS

| | | |
|---|---|---|
| CH | 272442 | 3/1951 |
| DE | 9014035 | 2/1991 |
| JP | 10035640 | 2/1998 |

OTHER PUBLICATIONS

PCT International Search Report dated Jul. 28, 2000.

* cited by examiner

*Primary Examiner*—Gary E. Elkins
(74) *Attorney, Agent, or Firm*—Burns, Doane, Swecker & Mathis, L.L.P.

(57) ABSTRACT

A sheet- or web-shaped packaging material for forming into dimensionally stable packages with straight, well-defined edges and good grip rigidity includes a layer of paper or paperboard which, for purposes of facilitating folding, and is provided with a suitable pattern of longitudinal material weakenings along which the packaging material is intended to be folded during the production of the packages. The straight, well-defined edges and good grip rigidity of the packages is made possible in that the longitudinal, fold-facilitating material weakenings are of substantially W-shaped cross section including two mutually parallel linear material ridges on the one side of the packaging material and two corresponding, mutually parallel material depressions on the other side of the packaging material.

7 Claims, 2 Drawing Sheets

Figure 3:
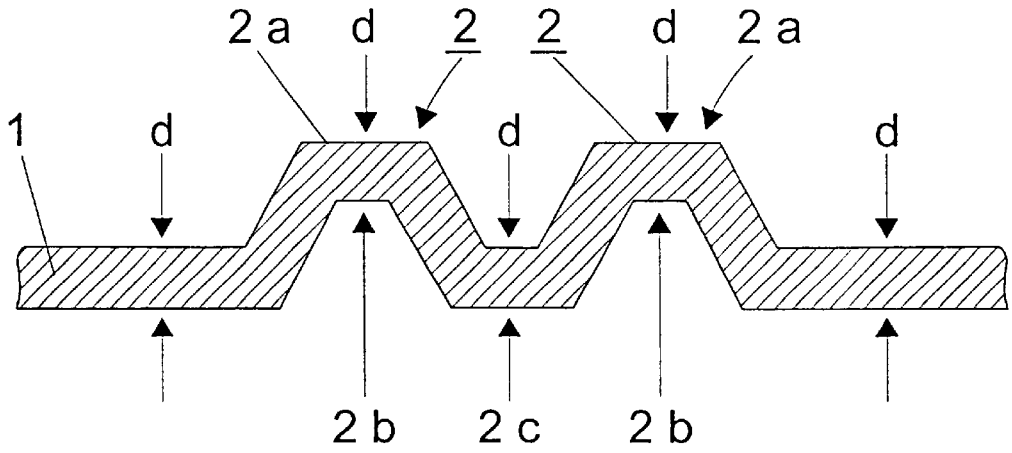

Fig.1
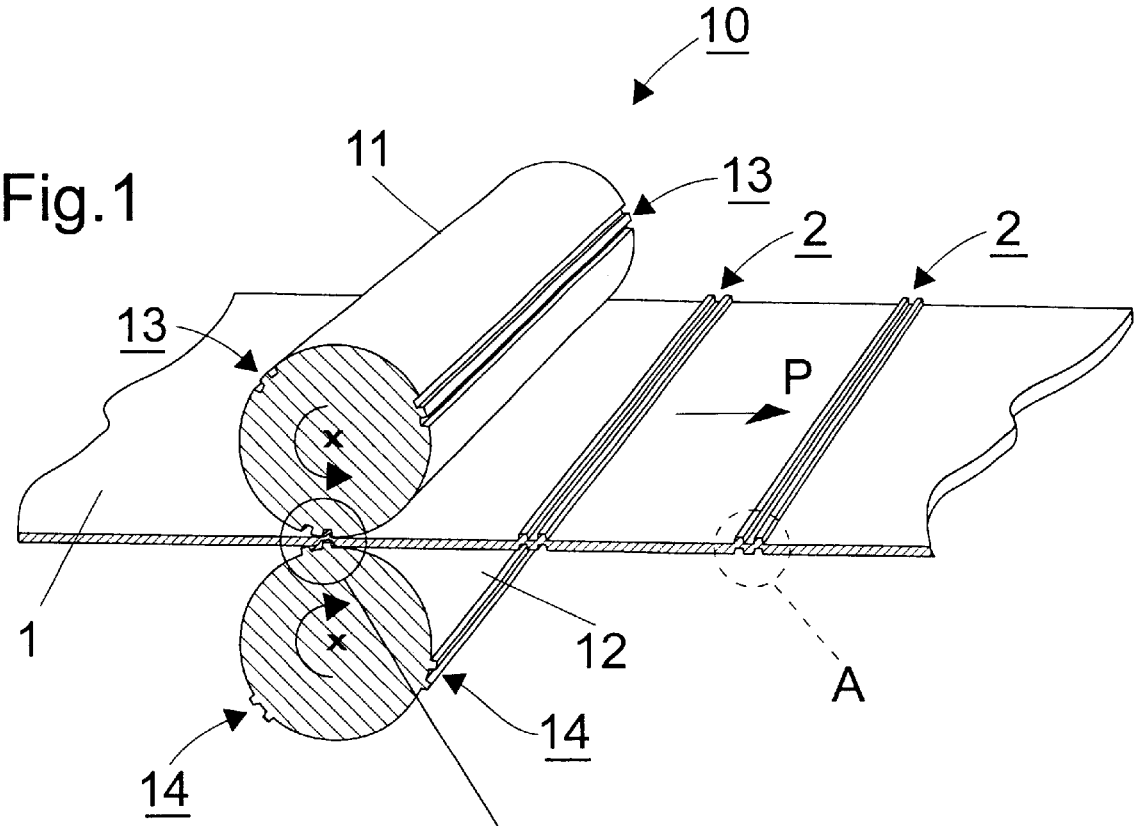
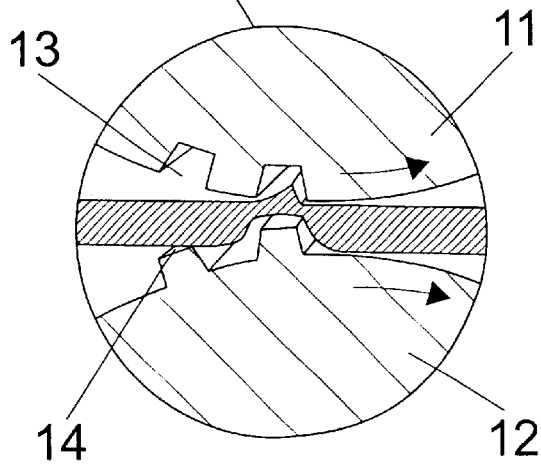
Fig.2

PACKAGING BLANK WITH LONGITUDINAL MATERIAL WEAKENINGS

TECHNICAL FIELD

The present invention relates to a sheet- or web-shaped packaging blank including longitudinal material weakenings along which the packaging blank is intended to be folded on forming into packages.

BACKGROUND ART

Within packaging technology, use is often made of packages of single-use disposable type, and a very large group of these so-called single use disposable packages is produced from a laminated, sheet- or web-shaped packaging blank comprising a relatively thick fibre layer of paper or paperboard and outer, liquid-tight coatings of plastic. In certain cases, in particular in conjunction with especially perishable and oxygen gas sensitive products, the packaging blank also displays an aluminum foil (Alifoil) in order to impart to the packages superior gas and light barrier properties.

Prior art single use packages are most generally produced with the aid of modern packing and filling machines of the type which both forms, fills and seals finished packages from a sheet-or web-shaped packaging blank. From, for example a web-shaped packaging blank, the packing and filling machine produces packages in that the web is first formed into a tube. The tube is filled with the pertinent contents and is divided into closed, filled package units. The package units are separated from one another and given the desired geometric configuration, normally parallelepiped, by a forming operation prior to discharge from the packing and filling machine for further transport and handling of the finished packages.

In order to facilitate the forming of the packaging blanks into packages, the packaging blank is, right from the outset, provided in a per se known manner with a suitable pattern of linear (both longitudinal and transverse) material weakenings or crease lines along which the packaging blank is intended to be folded on its forming into packages. In addition to facilitating fold-formation of the packaging blank, the linear material weakenings also contribute in imparting to the finished packages mechanical strength and stability so that the packages may be stacked and handled without the risk of being deformed or otherwise destroyed under normal handling. With the aid of the fold-facilitating material weakenings, the production is moreover made possible of packages of optional specially configured appearance which the packages maintain throughout their entire service life.

In a prior art method, a packaging material of paper or paperboard is provided with a desired pattern of linear material weakenings by mechanical processing of a web of the packaging material by means of a rotary roller which, on its peripheral surface, displays a corresponding pattern of linear radial projections. In this instance, the web is led through the nip between the rotating roller and a substantially smooth, but elastically yieldable counterpressure roller, the radial projections being urged against the one planar side of the web for compaction and "crushing" of the fibres within the regions of the engagement of the radial projections with the web. The web provided with crease lines is thereafter provided with at least one additional layer of plastic and/or other material by a lamination operation in order to impart to the packaging material the desired tightness and sealing properties prior to the forming of the packaging material into packages.

While a packaging material with fold-facilitating material weakenings within which the fibres are compacted and wholly or partly crushed does make for a simple fold-formation of the material, it has nevertheless proved difficult to produce attractive and stackable packages with the sought-for straight and well-defined folding edges and desired mechanical grip rigidity. Problems inherent in not entirely straight folding edges are particularly serious in large packages where straight folding edges are required in order to be able reliably to stack packages on one another without an excessive risk that the vertical fold edges of subjacent packages taking up the load in the stack are buckled or deformed during transport and normal handling of stacked packages.

OBJECTS OF THE INVENTION

One object of the present invention is therefore to obviate the above-discussed drawbacks and disadvantages inherent in the prior art technology.

A further object of the present invention is to realise a packaging material of the type described by way of introduction with fold-facilitating material weakenings which make for a simple fold-formation of the packaging material into packages with the sought-for straight and well-defined folding edges.

Yet a further object of the present invention is to realise a packaging material provided with fold-facilitating material weakenings for packages with attractive and well-defined geometric outer configuration and appearance as well as superior mechanical stability and grip rigidity.

Still a further object of the present invention is to realise a packaging material provided with fold-facilitating material weakenings for mechanically stable and stackable packages in order to make for reliable handling of such packages stacked on one another.

BRIEF DESCRIPTION OF THE ACCOMPANYING DRAWINGS

Figure 4:
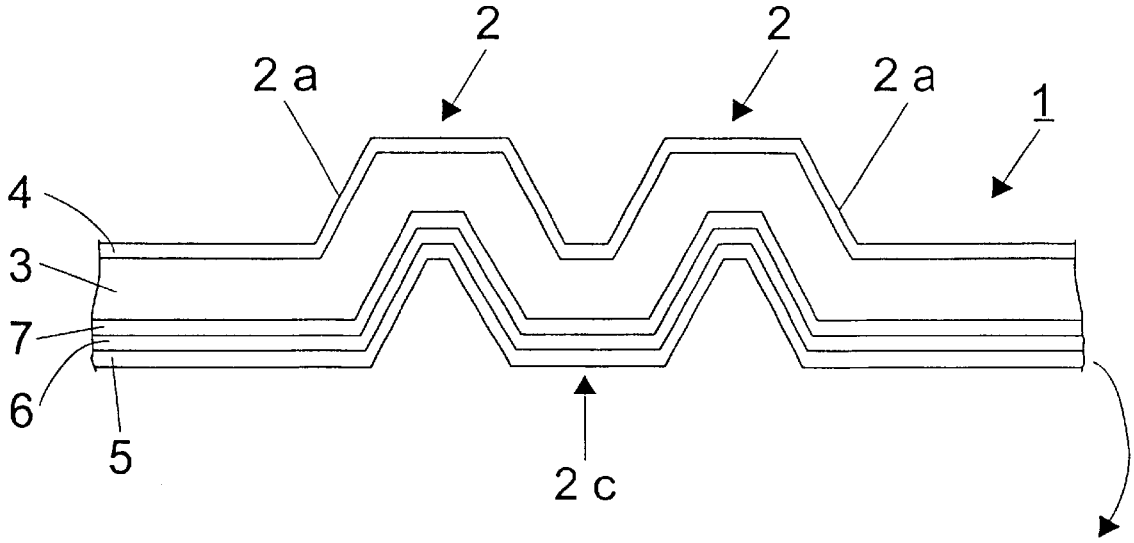

The present invention will now be described and elaborated on in greater detail hereinbelow, with reference to the accompanying Drawings, in which:

FIG. 1 schematically illustrates an apparatus for providing a web of paper or paperboard with linear material weakenings;

FIG. 2 shows the encircled region of FIG. 1 on a larger scale;

FIG. 3 schematically illustrates a cross section of the encircled region A in FIG. 1; and FIG. 4 is a cross section of a laminated packaging material with linear material weakenings.

DESCRIPTION OF PREFERRED EMBODIMENT

FIG. 1 thus schematically illustrates an apparatus carrying the generic reference numeral 10 for providing a web 1 of paper or paperboard with linear material weakenings 2. The apparatus 10 includes a first rotary roller 11 and a secondary rotary roller 12 which are disposed a short, adjustable distance in line the one above the other.

The first, or upper roller 11 has, on its peripheral surface, a recurring pattern of linear grooves 13 which, in the illustrated embodiment, extend pairwise in the horizontal longitudinal direction of the roller 11 transversely over the entire length of the roller.

The second, or lower roller 12 has, on its peripheral surface, a corresponding or complementary pattern of linear projections 14 which extend pairwise in the horizontal direction of the roller 12 transversely over the entire length of the roller.

It will be apparent from FIG. 2, which shows the encircled region in FIG. 1 on a larger scale, that the two rollers 11 and 12 are oriented in relation to one another such that the linear projections 14 on the peripheral surface of the lower roller 12 are brought into engagement with the corresponding linear grooves 13 on the peripheral surface of the upper roller 11 when the two rollers are rotated at the same speed of rotation in the directions of rotation shown by arrows in FIG. 1.

In operation, the web 1 is unreeled from a magazine reel (not shown) and led in the direction of the arrow P through the nip between the two rollers 11 and 12 which are rotated in the directions of rotation of the arrows at respective speeds of rotation which correspond to the speed of movement of the passing web. On passage of the web through the nip between the two rollers 11 and 12, the linear projections 14 on the lower roller 12 will progressively urge the web 1 into the complementary linear grooves 13 on the upper roller 11 for the formation of corresponding linear material weakenings which, in the illustrated embodiment, extend pairwise transversely over the entire width of the web between both of its longitudinal edges.

FIG. 3 shows the encircled region (A) of the web 1 in FIG. 1 and shows, on a larger scale, a cross section of pairwise linear material weakenings which have been produced by mechanical processing of the web with the two rollers 11 and 12 illustrated in FIG. 1 during the passage of the web through the nip between the rollers. The two linear material weakenings have a substantially M- or W-shaped cross section comprising two mutually parallel linear material ridges 2*a* on the one side of the web 1 and two corresponding, mutually parallel material depressions 2*b* on the other side of the web.

Between the two linear material ridges 2*a* and the material depressions 2*b*, respectively, the M- or W-shaped cross section of the web has a substantially planar intermediate portion 2*c* along which the web is intended to be folded for forming into packages with straight, well-defined folding edges and the desired dimensionally stable geometric outer configuration.

In the illustrated embodiment in FIG. 3, the web 1 or package blank has a substantially constant, unitary material thickness (d) transversely over its entire length. In other words, the material thickness of the web in the regions outside the M- or W-shaped cross section is equal to the material thickness of the web within the above-mentioned M- or W-shaped cross section. The material thickness of the web within the region of the substantially planar intermediate portion 2*c* is equal to the material thickness of the web in the regions of the two material ridges 2*a* and material depressions 2*b*, respectively.

From the web provided with linear material weakenings 2, a laminated packaging material of, for example, the type schematically illustrated in FIG. 4, is thereafter produced in a conventional manner by combined extrusion and film lamination. The laminated packaging material includes a rigidifying core layer 3 of paper or paperboard and outer, liquid-tight coatings 4 and 5 of plastic, normally polyethylene, on both sides of the core layer 3. Between the one outer plastic coating and the core layer 3, there is further provided an aluminium foil (Alifoil) 6, serving as gas barrier which, by means of an interjacent layer 7 of adhesive, is bonded to the core layer 3.

A laminated packaging material of the type which is shown in FIG. 4 is well-known in the art and is often employed for the production of consumer packages of single use disposable type for the transport and handling of liquid foods such as wine, juice, cooking oil and similar perishable or oxygen gas sensitive products. Such so-called single use disposable packages are produced, as descried previously, by fold-formation of a web of the packaging material along the fold-facilitating material weakenings 2 according to the present invention. In the illustrated embodiment in FIG. 4, the packaging material 1 is folded in the direction of the arrow approximately 90° downwards for the formation of a sharp, well-defined longitudinal outer edge on the finished package (not shown) with the two material ridges 2*a* facing outwards and the interjacent planar portion 2*c* turned to face inwards in the package.

It will be apparent from the foregoing description that the present invention, with but simple means, makes for the production of packages with the sought-for straight, well-defined folding edges by means of which the package may be given optional attractive geometric outer configuration which the package maintains throughout its entire service life.

While the present invention has been described and illustrated in connection with a web of packaging material with linear material weakenings oriented transversely of the longitudinal direction of the web, it will be obvious to a person skilled in the art that the present invention is not restricted exclusively to thus oriented material weakenings. In practice, such linear material weakenings may, according to the present invention, be oriented in any desired direction and in any desired pattern which is ultimately determined by the desired outer configuration of the finished package. Linear material weakenings according to the present invention can thus be oriented both transversely and axially on a web of packaging material for obtaining transverse or longitudinal fold-facilitating crease lines, respectively.

Nor is the present invention restricted as regards the laminate structure of the packaging material. It will be obvious to the skilled reader of this specification that other material layers than those described above may also be employed and may even be preferred over those specifically described above. The ultimate choice of laminate structure and barrier properties in the finished packaging material is determined by the product or type of product which is to be packed in the package produced from the packaging material.

All such modifications and variations as are obvious and self-evident to a person skilled in the art lie within the scope of the inventive concept as this is defined by the appended Claims.

What is claimed is:

1. A packaging blank including longitudinal material weakenings along which the packaging blank is intended to be folded for forming into packages, wherein the packaging blank is, within a region of the longitudinal material weakenings, of substantially W-shaped cross section, the packaging blank including a relatively thick fiber layer of paper or paperboard wherein fibers in the paper or paperboard are substantially torn loose from each other within a region of material ridges and material depressions, respectively.

2. The packing blank as claimed in claim 1, wherein the W-shaped cross section of the packaging blank comprises two mutually parallel linear material ridges on a first side of the packaging blank and two corresponding, mutually parallel material depressions on a second side of the packaging blank.

3. The packing blank as claimed in claim 2, wherein the W-shaped cross section of the packaging blank has a substantially planar intermediate portion between the two material ridges and the material depressions, respectively.

4. The packaging blank as claimed in claim 1, wherein the packaging blank is of a substantially constant, unitary material thickness throughout an entire length of the packaging blank.

5. The packing blank as claimed in claim 1, wherein the longitudinal material weakenings are oriented substantially in line with fibers in the paper or paperboard layer.

6. The packaging blank as claimed in claim 1, further comprising an aluminum foil.

7. The packaging blank as claimed in claim 1, wherein the packaging blank displays outer, liquid-tight coatings of plastic on both of said first and second sides.

* * * * *